US008295522B2

(12) United States Patent
Vestergaard et al.

(10) Patent No.: US 8,295,522 B2
(45) Date of Patent: Oct. 23, 2012

(54) FILTER FOR A HEARING AID AND A HEARING AID

(75) Inventors: Jorn Eiler Vestergaard, Helsinge (DK); Jorgen Mejner Olsen, Hillerod (DK); Leif Hojslet Christensen, Roskilde (DK); Kenneth B. Haugshoj, Tasstrup (DK)

(73) Assignee: Widex A/S, Lynge (DK)

( * ) Notice: Subject to any disclaimer, the term of this patent is extended or adjusted under 35 U.S.C. 154(b) by 576 days.

(21) Appl. No.: 12/370,183

(22) Filed: Feb. 12, 2009

(65) Prior Publication Data

US 2009/0154747 A1 Jun. 18, 2009

Related U.S. Application Data

(63) Continuation-in-part of application No. PCT/DK2006/000470, filed on Aug. 31, 2006.

(51) Int. Cl.
*H04R 25/00* (2006.01)

(52) U.S. Cl. ..... 381/325; 381/312; 381/324

(58) Field of Classification Search ..... 381/312–331
See application file for complete search history.

(56) References Cited

U.S. PATENT DOCUMENTS

| | | | | |
|---|---|---|---|---|
| 3,354,022 | A | 11/1967 | Dettre et al. | |
| 5,530,763 | A | 6/1996 | Aebi et al. | |
| 6,493,454 | B1 | 12/2002 | Loi et al. | |
| 6,859,542 | B2 * | 2/2005 | Johannsen et al. | 381/174 |
| 7,191,029 | B2 | 3/2007 | Marxen et al. | |
| 7,313,245 | B1 * | 12/2007 | Shennib | 381/325 |
| 2004/0213904 | A1 | 10/2004 | Muller et al. | |
| 2005/0141738 | A1 | 6/2005 | Karamuk | |
| 2006/0147071 | A1 * | 7/2006 | Neilson | 381/325 |
| 2009/0262966 | A1 | 10/2009 | Vestergaard | |

FOREIGN PATENT DOCUMENTS

| | | | |
|---|---|---|---|
| DE | 102004062279 | A1 | 5/2006 |
| EP | 1432285 | A2 | 6/2004 |
| EP | 1458217 | A2 | 9/2004 |
| JP | 8163699 | A | 6/1996 |
| JP | 09215099 | | 8/1997 |
| JP | 2000158157 | A | 6/2000 |
| JP | 2003236847 | A | 8/2003 |
| JP | 2003236895 | A | 8/2003 |
| JP | 2006144029 | A | 6/2006 |
| WO | 0003561 | A1 | 1/2000 |
| WO | 0058415 | A1 | 10/2000 |
| WO | 2004073351 | A1 | 8/2004 |

(Continued)

OTHER PUBLICATIONS

JP Office Action for JP2009543343 dated Nov. 18, 2011 with English Translation.

(Continued)

*Primary Examiner* — Yuwen Pan
*Assistant Examiner* — Matthew Eason
(74) *Attorney, Agent, or Firm* — Sughrue Mion, PLLC

(57) ABSTRACT

A hearing aid (1) comprises a receiver (19), an output port (6), a conduit (13) for conveying sound to the port and a barrier element (39) adapted for baffling entry of ear wax and moisture and for being acoustically transparent. The invention further provides a barrier element (39) for a hearing aid comprising a slab having an exterior surface and through openings for transverse transmission of sound, wherein the exterior surface is super-hydrophobic.

10 Claims, 4 Drawing Sheets

FOREIGN PATENT DOCUMENTS

| | | | |
|---|---|---|---|
| WO | 2005039234 | A2 | 4/2005 |
| WO | 2005051040 | A1 | 6/2005 |
| WO | 2005079373 | A2 | 9/2005 |
| WO | 2007005852 | A2 | 1/2007 |

OTHER PUBLICATIONS

Office Action for JP2009524899 dated Mar. 13, 2012 with English Translation.
Office Action for JP2009543343 dated Apr. 17, 2012 with English translation.
* cited by examiner

FILTER FOR A HEARING AID AND A HEARING AID

RELATED APPLICATIONS

The present application is a continuation-in-part of application no. PCT/DK2006/000470 filed on Aug. 31, 2006 and published as WO-A1-2008025355, the contents of which are incorporated herein by reference.

BACKGROUND OF THE INVENTION

1. Field of the Invention

The present invention relates to hearing aids. The invention, more specifically, relates to a filter for a hearing aid.

ITE hearings aids generally comprise a shell, which anatomically duplicates the relevant part of the user's ear canal. A receiver is placed in the shell in communication with an acoustic outlet port arranged at the proximal end, i.e. the end of the shell intended to be situated in the ear canal close to the tympanic membrane. The distal end of the shell, i.e. the opposite end, intended to be oriented towards the surroundings, is closed by a faceplate subassembly, connected to the receiver by leads. The faceplate subassembly incorporates a microphone, electronics, a battery compartment and a hinged lid. The microphone communicates with the exterior through a port, which may covered by a grid.

Whereas an ITE hearing aid may be regarded as an earpiece integrating all parts of a hearing aid, a BTE hearing aid comprises a housing adapted for resting over the pinna of the user and an ear piece adapted for insertion into the ear canal of the user and serving to convey the desired acoustic output into the ear canal. The earpiece is connected to the BTE housing by a sound conduit or, in case it houses the receiver, by electric leads. In either case it has an output port for conveying the sound output.

2. Description of the Related Art

WO-A1-00/03561 provides an in-the-ear hearing aid wherein the acoustic outlet port is protected against contamination by earwax by means of an earwax guard, which is inserted in port. An elastic hose connects the port to a receiver. The earwax guard comprises an essentially tubular element with a through-going cavity and an abutment collar in one end for sealing abutment against an edge of the hearing aid housing adjacent the port.

EP-A2-1432285 shows a method for hydrophobic coating of components for a hearing aid, such as for the battery lid, the battery compartment, the housing or a switch.

DE-A1-102004062279 shows an earwax guard for a hearing aid, which has been provided with an oleophobic or biofilm-inhibiting coating.

EP-A2-1458217 shows an acoustic filter of a hearing instrument, detachably placed nearby or at the opening for the acoustic output of the instrument. The filtering element is made of a polymer material, a synthetic, metallic or ceramic material or a fabric-like material.

EP-A2-1432285 provides a method for hydrophobic coating of a hearing aid for the purpose of preventing entry of moisture into crevices and openings of the housing.

U.S. Pat. No. 3,354,022 provides a water-repellant surface having high and low portions with an average distance between high portions of not more than 1000 microns and an average height of high portions of at least 0.5 times the average distance between them; and having an air content of at least 60%. The air content of the surface is determined by taking an imaginary plane parallel to the surface passing through the tops of the high portions of the surface and measuring at this plane the percentage of the total surface area which is air. The surfaces may be coated with a solid having a water contact angle of greater than 90 degrees. These surfaces are highly water repellant.

WO-A1-0058415 provides a device for the loss-free transport or emptying of hydrophilic liquids, which device has raised areas and cavities on the side facing the liquid, the distance between the raised areas being between 0.1 and 200 microns and the height of said raised areas between 0.1 and 100 microns, and the raised areas being hydrophobic.

With a hearing aid or an ear piece having an output port inserted into the ear canal of a user there is a risk of earwax or moisture entering the port. The earwax may slowly accumulate or it may be driven into the port by the manipulation of inserting the hearing aid or the ear piece into the ear canal. The result is that the port clogs and baffles the acoustic output. For preventing this it is a standard practice to fit the output port with a replaceable earwax guard. The earwax guard incorporates baffles or a grid for establishing a barrier against the entry of earwax while permitting the passage of sound. The earwax guard may not be effective to entirely prevent the entry of moisture. The earwax may accumulate on the earwax guard. Once the earwax guard has been clogged, it is removed and replaced by a new one.

As far as pertains the microphone port, there may also be a risk of entry of moisture and earwax, although there may be less exposure to earwax as the microphone port faces the surroundings rather than the ear canal. A grid may be provided, although it may not be effective for protection against the entry of moisture.

With a hearing aid fitted with an earwax guard adapted for easy removal, there is the risk that the earwax guard accidentally is lost, or that the user removes it without inserting a new one, e.g. if he or she has no replacement available. When using the hearing aid without the earwax guard there is a risk of earwax entering deeper into the hose and ultimately into the receiver, where it may clog the receiver membrane or it may accumulate on the integral acoustic filter, if present. The same might happen if the earwax guard was not effective, i.e. if it was open for penetration of earwax. In either case, the outcome is a costly service operation, involving disassembly or replacement of the receiver. It is estimated that a major proportion of service issues with hearing aids is related to the entry of earwax or moisture into the output port.

Providing the receiver with an external acoustic filter complicates logistics. An acoustic filter normally serves to correct acoustic artifacts of the receiver. An acoustic filter works by absorbing acoustic energy, e.g. for dampening resonance peaks or otherwise shaping the frequency response. The acoustic filter must be tailored to the particular receiver in order to provide a satisfactory shaping with minimal loss of acoustic energy.

For logistic reasons it would be easier if a standard earwax guard could be used for all types of hearing aids. However, a standard earwax guard necessarily must be acoustically transparent in order not to absorb energy and possibly distort the desired acoustic output in a non-controlled way. The requirement for the filter being acoustically transparent runs against the consideration of the filter providing an effective barrier against earwax and moisture. Therefore general earwax guards may not be effective for preventing the entry of moisture.

SUMMARY OF THE INVENTION

The invention, in a first aspect, provides a hearing aid comprising a receiver, an output port, a conduit for conveying sound to the port and a barrier element adapted for baffling entry of ear wax and moisture and for being acoustically transparent, wherein the barrier element comprises a slab with an exterior surface that has been microstructured and surface coated by molecular vapor deposition with a moisture repellant matter in such a way as to make the surface super-hydrophobic, and wherein the barrier element has a number of through-going pores, the diameter d of each of the pores being smaller than 200 microns.

This provides a hearing aid with a barrier element that combines superior barrier properties against the entry of ear-wax and moisture with superior acoustic properties. The barrier element may be integrated into the earwax guard or it can be arranged in series with the earwax guard to provide an extra line of defense.

The barrier element comprises a slab with an exterior surface, the exterior surface being surface coated by molecular vapor deposition with a moisture repellant matter. Suitable matters are silanes such as perfluoroalkylsilanes or alkylsilanes. The silanes are chemically attached to the surface by reaction between hydroxy groups on the silane and on the surface, forming a self assembled monolayer (SAM).

Applicants have discovered that microstructuring of the exterior surface enhances the water repellant properties. The term exterior surface is here used to designate a surface intended for generally facing the environment exterior to the hearing aid, as opposed to a surface intended to face inner parts of the hearing aid.

According to an embodiment, the barrier element has a number of through-going pores, the diameter d of each of the pores being smaller than 100 microns. In the context of circular openings the diameter is well known. In case of pores with non-circular cross sections the diameter designates the largest lateral dimension.

The pores provide openings for conveying the sound. The small size of the pores prevents the passage of fluids.

According to an embodiment, the barrier element is fitted inside the earpiece so as to be inaccessible to the general user. This eliminates the risk of the barrier element getting lost, and thereby protects the more costly internal parts.

According to an embodiment, the earwax guard in the port is arranged acoustically downstream of the barrier element. This places the earwax guard first in line to collect earwax, which is advantageous as it is the easy part to replace.

According to an embodiment, the acoustic filter is arranged acoustically upstream of the barrier element. Hereby the barrier element does not interfere with the intended function of the acoustic filter.

Further advantageous features appear from the dependent claims.

The invention, in a second aspect, provides a barrier element for a hearing aid comprising a slab having an exterior surface and through-going openings for transverse transmission of sound, wherein the exterior surface has been micro-structured and surface coated by molecular vapor deposition with a moisture repellant matter in such a way as to make the surface super-hydrophobic, and wherein the through-going openings comprises pores each having a diameter d smaller than 200 microns.

Within the present context, surfaces exhibiting a contact angle to water exceeding 120° are termed super-hydrophobic. Suitable surfaces may be produced by selecting appropriate materials and providing a micro-surface structure with a high air content. Still other objects of the present invention will become apparent to those skilled in the art from the following description wherein the invention will be explained in greater detail.

BRIEF DESCRIPTION OF THE DRAWINGS

By way of example, there is shown and described a preferred embodiment of this invention. As will be realized, the invention is capable of other different embodiments, and its several details are capable of modification in various, obvious aspects all without departing from the invention. Accordingly, the drawings and descriptions will be regarded as illustrative in nature and not as restrictive. In the drawings.

DETAILED DESCRIPTION OF THE INVENTION

Figure 1:
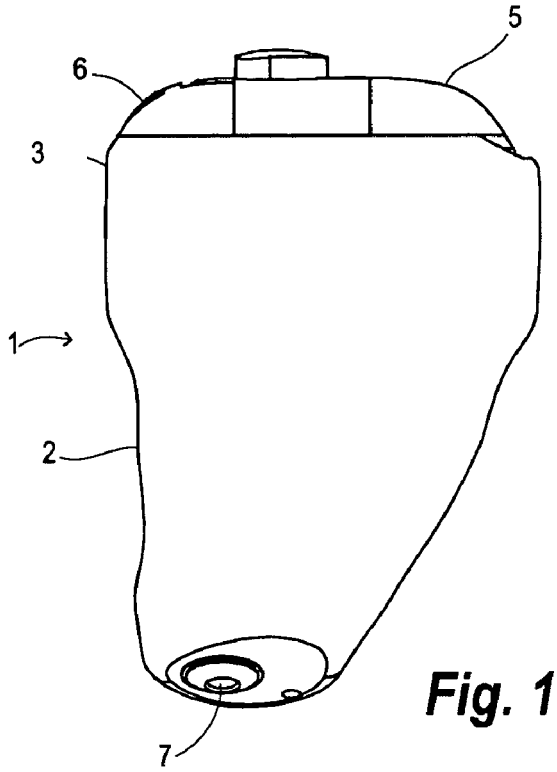
FIG. 1 shows a hearing aid.

Reference is first made to FIG. 1, which illustrates a hearing aid 1 generally comprising a shell 2, a faceplate 3, a lid 5, a sound inlet port 6 and a sound output port 7. The hearing aid 1 is adapted to be positioned in the auditory canal of a user with the sound output port 7 facing the user's tympanic membrane.

Figure 2:
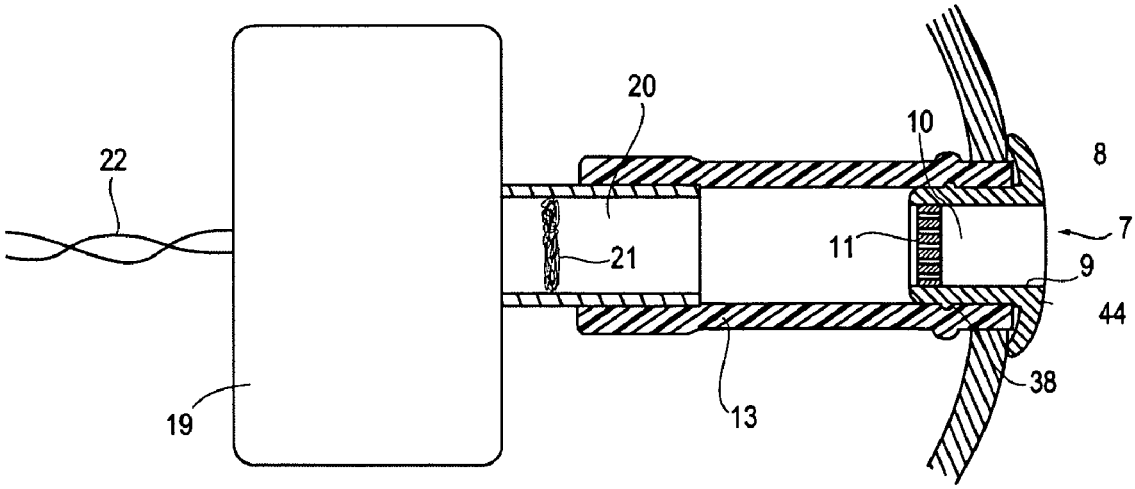
FIG. 2 shows a section through part of the hearing aid including the output port and a barrier element according to a first embodiment of the invention.
Figure 3:
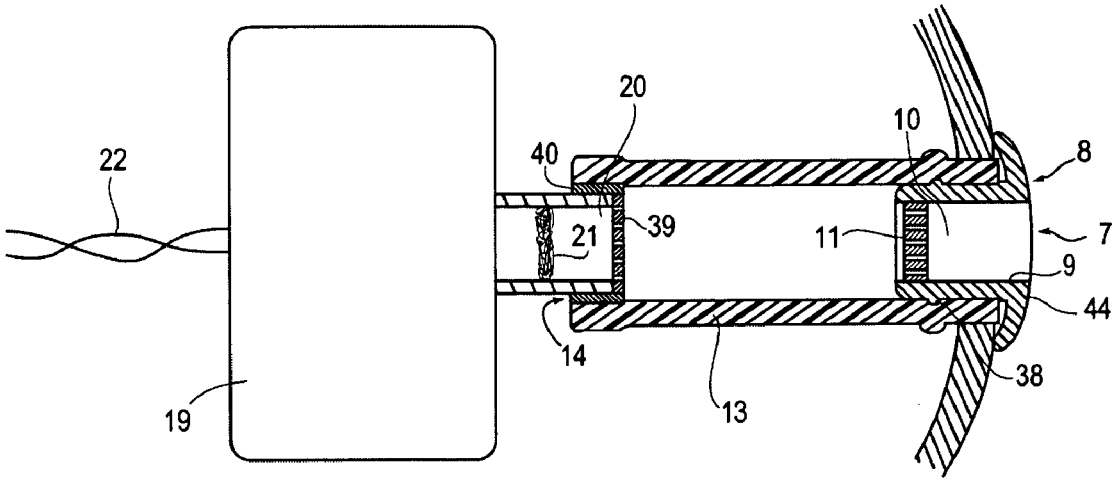
FIG. 3 shows a section through part of the hearing aid including the sound output port and two barrier elements according to a first and a second embodiment of the invention.

Reference is now made to FIG. 2 and FIG. 3 for exemplifying the placement and use of a barrier element according to the invention.

FIG. 2 illustrates the sound output segment of the hearing aid comprising a receiver body 19, leads 22 for electrical connection, a receiver stub 20, housing an acoustic filter 21, and a tube or hose 13, which connects the receiver stub 20 with an aperture in the shell 2, that defines the sound output port 7. Inserted in the hose 13 is a barrier element according to a first embodiment of the invention, in the form of an earwax guard 8 which comprises a cylindrical body 9 having a through-going bore 10 which is partially closed at one end by an earwax retaining strainer 11. At the opposite end the cylindrical body 9 is provided with a round-going collar 44, which in the inserted position abuts against an end wall part of the shell 2. The earwax guard 8 is frictionally engaged with tube 13 by an annular bead 38 on the cylindrical body 9 and is thereby held in position during use of the hearing aid 1.

When a quantity of earwax has accumulated in the earwax guard 8 to significantly reduce the sound output from the receiver, the user removes the earwax guard 8 using an applicator (not shown) and replaces it with a new earwax guard. Further details of the earwax guard and the applicator can be obtained from WO-A1-00/03561.

FIG. 3 illustrates the sound output segment of hearing aid 1 including a barrier element according to a second embodiment of the invention in the form of a protection cap 14, which is mounted in the receiver stub 20 or in the hose 13. The protection cap 14 comprises a receiver protection strainer 39 in a supporting ring 40. The protection cap 14 serves as an additional barrier to protect the receiver from wax or sweat that for some reason enters the tube 13. This may for example happen if the earwax guard 8 falls out of the sound output port 7 during use of the hearing aid 1. Further, the presence of the protection cap 14 is advantageous in a situation where the user is out of earwax guards but still wants to use the hearing aid, or in case the user simply forgets to insert an earwax guard. The protection cap 14 will thus minimize the risk of receiver malfunction as a consequence of intruding earwax and sweat.

Contrary to the replaceable earwax guard 8, the protection cap 14 is an internal component of the hearing aid and is thus inaccessible to the user.

Figure 4:
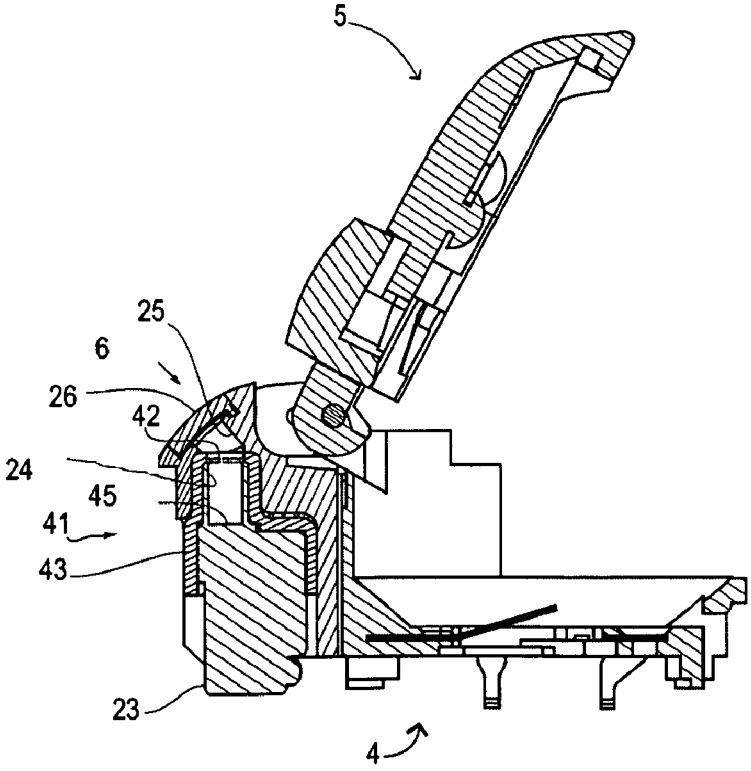
FIG. 4 shows a section through part of the hearing aid including the sound inlet port.

FIG. 4 shows a sub-assembly of hearing aid 1, mainly consisting of an electronics module 4, a microphone adaptor 41 and the lid 5. The microphone adaptor 41 comprises the sound inlet port 6, partially covered by a microphone grid 26, a sound inlet conduit 25, a microphone stub 24, a gasket 43, a microphone port 45, and a microphone 23. The microphone adaptor 41 further includes a barrier element according to a third embodiment of the invention in the form of a microphone protection strainer 42, which is positioned in the vicinity of the microphone 23. In FIG. 4 the microphone protection strainer 42 is positioned just outside the microphone stub 24.

The strainer 11, the receiver protection strainer 39, and the microphone protection strainer 42 have surfaces which are modified to exhibit improved barrier properties towards aqueous and oily substances, as will be explained in greater detail below. The primary function of the barrier elements is to protect the receiver 19 and the microphone 23 from potentially damaging intrusion of for example earwax, water or sweat.

In the present context improved barrier properties towards aqueous and oily substances means an improved ability of the barrier element surface to repel such substances. Generally, the ability of a solid surface to repel a liquid substance can be determined in terms of wetting.

Figure 5:
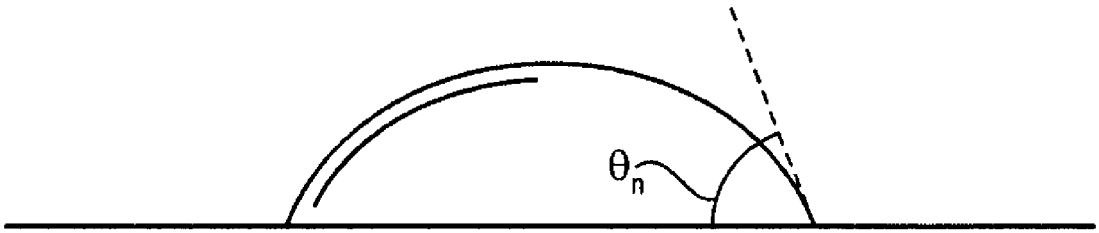
FIG. 5 shows a section of a droplet on a surface exhibiting a small contact angle.

One quantitative measure of the wetting of a solid by a liquid is the contact angle, which is defined geometrically as the internal angle formed by a liquid at the three-phase boundary where the liquid, gas and solid intersect. This is illustrated in FIG. 5, where $\theta_n$ denotes the contact angle of a water droplet on a normal untreated surface and in FIG. 6, where $\theta_m$ denotes the contact angle of a water droplet on a modified surface.

Contact angle values below 90° indicate that the liquid spreads out over the solid surface in which case the liquid is said to wet the solid. If the contact angle is greater than 90° the liquid instead tends to form droplets on the solid surface and is said to exhibit a non-wetting behavior.

In this terminology it follows that the larger the contact angle, the better the ability of a surface to repel a specific substance. As indicated in FIG. 5, for untreated surfaces the contact angle is normally less than 90°. It is well known in the art to coat a solid with a hydrophobic layer in order to increase the contact angle and thereby obtain a moisture repellent surface. Such a surface coating may typically increase the contact angle of water to around 115-120°.

Figure 6:
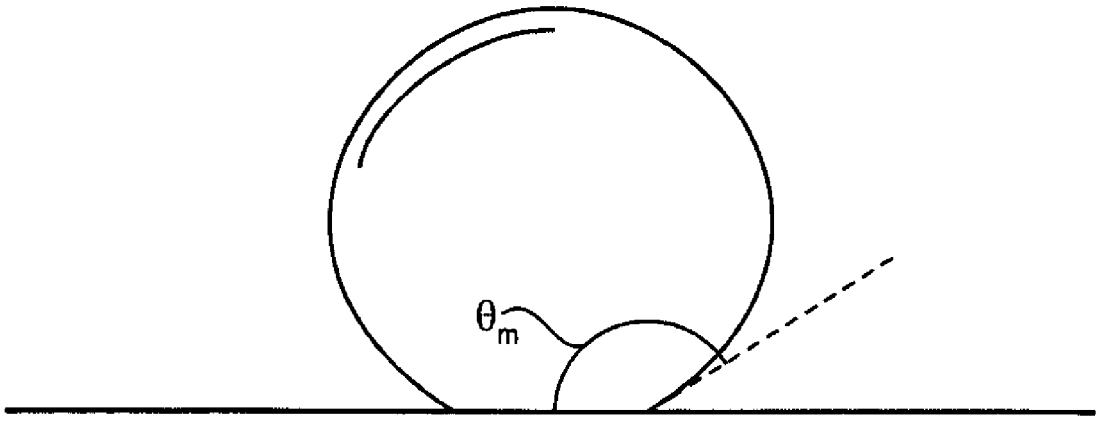
FIG. 6 shows a section of a droplet on a surface exhibiting a large contact angle.

Applicants have discovered that a structural modification of the surface of certain materials will improve the ability of the material to repel aqueous and oily substances. The inventors have further discovered that the combination of structural modification and coating significantly improves barrier properties of the surface. FIG. 6 shows a water droplet on a surface, which has been modified according to the invention. The increased contact angle substantially exceeds 90°. In fact, as documented below, when the surface is modified by a combination of a structuring and a coating, the contact angle of water exceeds 145° for a variety of materials. The obtained surface characteristics may be termed super-hydrophobic. In addition to the super-hydrophobic surface characteristics, the modified materials obtained super-oleophobic surface characteristics, as will also become clear in the following.

The barrier element surface modification will now be described in more detail beginning with the surface structuring.

The surface structuring is preferably realized on lateral scales that are much larger than characteristic sizes for atoms and molecules as well as for grains or other sub-nanometer structures. The upper limit for the lateral scale will typically be in the order of 10 microns or larger. The aspect ratio is typically about 1:1 or larger.

The applied structure can be periodic, quasi-periodic or random within a certain spatial bandwidth.

The spatial bandwidth is defined as the range of reciprocal wavenumbers of the lateral scales of the structure, the wavenumber being defined as the reciprocal value of the lateral wavelength of a periodic structure. The structure is applied to at least a part of the barrier element surface.

The surface structuring may be performed by a number of methods, for example by laser processing of the surface with thermal or non-thermal interactions. Non-limiting examples of lasers that can be used for surface structuring are $CO_2$ lasers, solid state lasers, such as Nd:YAG, picosecond lasers and femtosecond lasers.

Processes used in the fabrication of micro/nano-electronics or micro/nano-electromechanical systems as well as other etching or electrochemical processes can also be applied.

Figure 7:
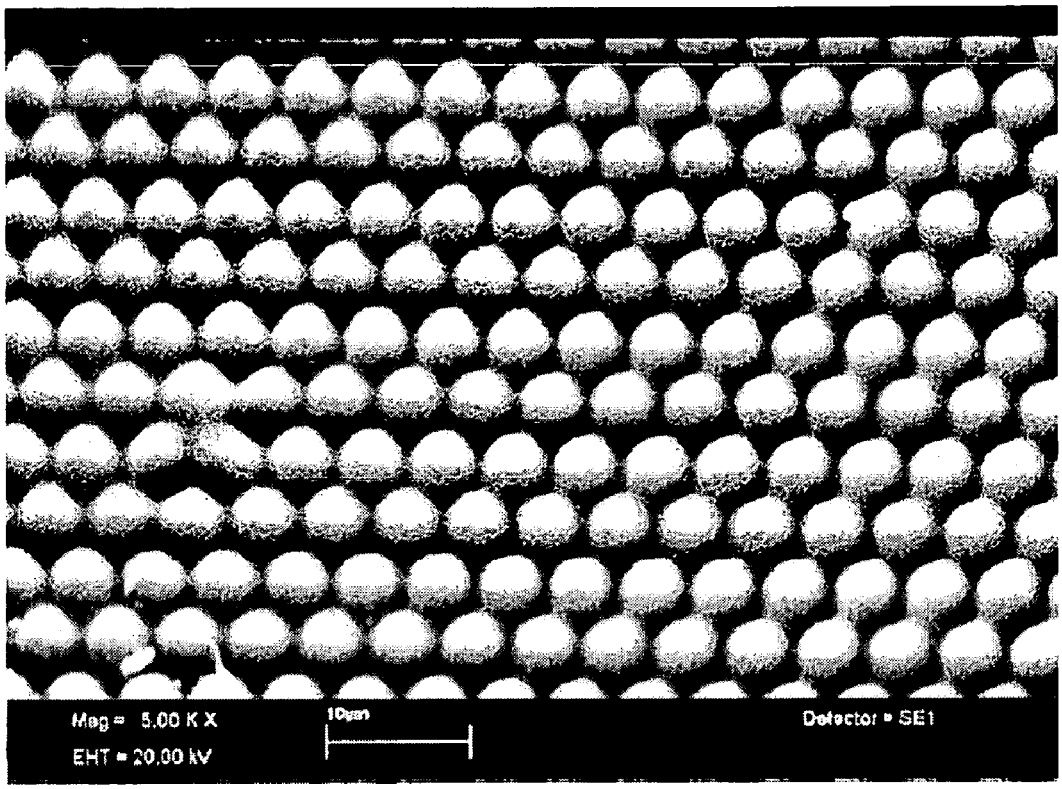
FIG. 7 shows a plan view of the barrier element according to an embodiment of the invention.

Reference is made to FIG. 7 for an example of a laser structured barrier element surface according to the invention, as seen through a microscope.

The coating may be applied using a gas phase nano-coating process. The process is based on applying a hydrophobic coating to a surface using silanes such as perfluoroalkylsilanes or alkylsilanes. The silanes are chemically attached to the surface by reaction between hydroxy groups on the silane and on the surface, forming a self-assembled monolayer.

Firstly, the material to be coated is rendered active by treatment with a plasma, e.g. an oxygen plasma. The plasma treatment both acts as a cleaning of the surface and as a way of making the surface reactive by the introduction of hydroxy groups into the surface.

Preferably, an adhesion layer that further enhances the reactivity of the surface by creating even more hydroxy groups may then be deposited and preferably, a catalyst is added to promote deposition of the adhesion layer. This step is necessary for non-metallic substrates and also for glasses and some metals in order to create stable coatings.

In the last step, a silane is then reacted with the activated surface with or without adhesion layer. Preferably, a catalyst is added to promote deposition of the silane.

Both silane and adhesion layer are preferably deposited using a vapor phase reaction scheme. Preferably, the equipment is so designed as to have a reaction chamber and separate reservoirs containing the different chemistries used (silane, adhesion layer precursor and a catalyst) and a remote plasma source. From each reservoir, well-defined amounts of the different chemistries are evaporated into a vaporization chamber, from where the vapor is injected into the reaction chamber once a specified pressure in the vaporization chamber has been reached. The connections between each reservoir and the vaporization chamber and between the vaporization chamber and the reaction chamber are controlled by valves. The reservoirs and the transfer lines may be heated if necessary in order to promote vaporization and to avoid condensation in the transfer lines. Also, the reaction chamber may be heated.

The system is initially pumped so as to keep a low pressure in the reaction chamber, transfer lines and vaporization chamber. Thereafter, the pumping action is halted and the compounds in the reservoirs are allowed to evaporate into the vaporization chamber. Once the pre-set pressure in the vaporization chamber has been reached the vapor is injected into the reaction chamber by action of the pressure difference between the vaporization chamber and the reaction chamber. Once a reaction step is completed the reaction chamber, transfer lines and vaporization chamber are pumped down, after which a new reaction cycle can start.

Other gas phase deposition schemes may be used, but the setup described above has the advantage that plasma activation, deposition of adhesion layer and deposition of the silane are carried out in the same equipment in an automated fashion, providing no need for user intervention between the individual steps. Furthermore, the precise control over the injected amounts of chemical substances into the reaction chamber and the control over the total pressure in the reaction chamber are advantageous in order to obtain a good quality of the coating both with respect to structure and surface binding.

Alternatively, after plasma activation the process may be performed in liquid solution with the same deposition steps as previously described. The gas phase deposition is, however, the preferred technique, as the liquid phase deposition is more cumbersome and demands several rinse steps.

Also, polymerization of the silane in the liquid phase produces by-products that may only be deposited onto the surface via physical adsorption and not chemical binding, resulting in both low-quality coatings and in irreproducible coating thicknesses.

The structuring and/or coating can be applied to the entire barrier element surface or it can be applied to a part of it. A controlled structuring of at least a part of the surface in the immediate vicinity of the pores is particularly advantageous.

Figure 8:
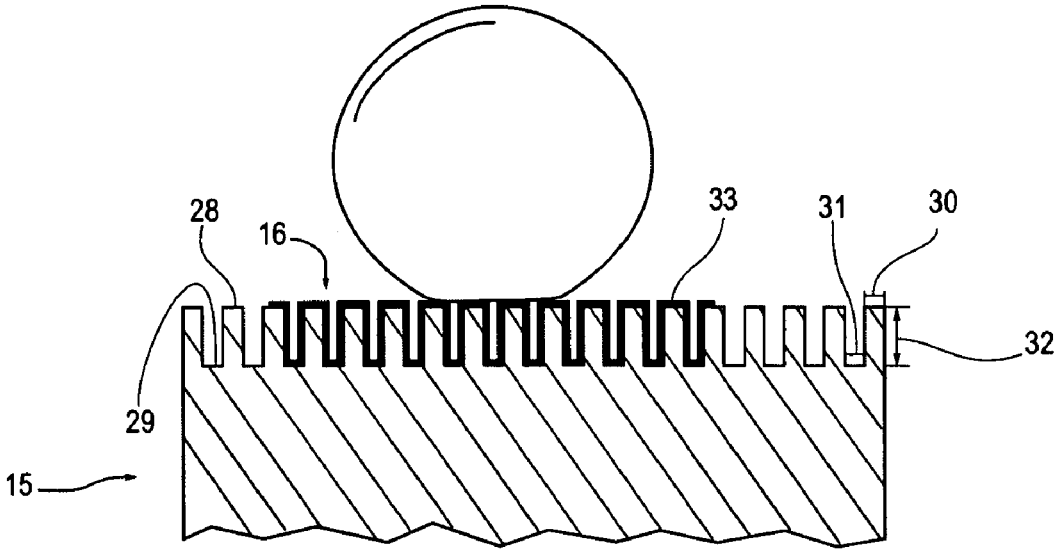
FIG. 8 shows a section in a barrier element according to another embodiment of the invention.

Reference is made to FIG. 8 for an illustration of a barrier 15 having an exterior surface 16, which is structured and coated according to an embodiment of the invention. The surface is characterized by a square-wave like profile having alternating peaks 28 and troughs 29 which can be described in terms of peak height 32, peak width 30 and trough width 31. A part of the surface is further provided with a coating 33.

The barrier performance has been tested for different materials with different surface structures. A hexagonal pattern of columns on polytetrafluoroethylene (Teflon®) was produced with a femtosecond laser. The column width at the bottom was approximately 40 microns and the spacing about 40 microns. Each column had a microstructure generated by the ablation process, which is non-thermal. This ensures that surface tension does not smooth the surface locally. Typical fill factors are below 50%. The fill factor is defined as the ratio of the amount of material left relative to the amount of material that is removed from the surface layer. The average laser power was 100 mW, the pulse repetition rate was 6 kHz, the optical wavelength was 775 nm, and the pulse width was 150 fs. An increase in contact angle from about 115 degrees to about 150 degrees was observed after the processing, which included the coating.

Equivalent experiments were performed with polyethylene (Stamylex®, available from DEXPlastomers v.o.f., Heerlen, The Netherlands). The average laser power was 50 mW. An even more dramatic change in contact angle was observed. Experiments on stainless steel have also been performed with equivalent results. The average laser power was in this case 275 mW. Experiments on steel with random structures generated in conjunction with the formation of pores of a diameter of 80 microns have produced similar results.

Contact angles obtained for water and olive oil on different surfaces are displayed in the below tables. Olive oil can be regarded as a representative of liquid earwax.

The clean surfaces have undergone oxygen plasma treatment for 10 minutes. The structured surfaces were created by a femtosecond laser with a wavelength of 775 nm and obtained peak heights of 25 microns. The surfaces were coated by molecular vapor deposition.

TABLE 1

Contact angles for water

| Substrate | Clean surface (°) | Structured surface (°) | Coated surface (°) | Structured and coated surface (°) |
|---|---|---|---|---|
| Steel | 85 ± 5 | 55 ± 5 | 115 ± 5 | 155 ± 5 |
| Glass | 40 ± 5 | 10 ± 5 | 115 ± 5 | 150 ± 5 |
| Polyimide | 70 ± 5 | <15 | 115 ± 5 | 160 ± 5 |
| PET | 80 ± 5 | 125 ± 5 | 115 ± 5 | 150 ± 5 |
| PE (Stamylex) | 90 ± 5 | 125 ± 5 | 115 ± 5 | 160 ± 5 |
| FEP (Teflon ®-like) | 120 ± 5 | 155 ± 5 | 115 ± 5 | 160 ± 5 |

TABLE 2

Contact angles for olive oil

| Substrate | Cleaned surface (°) | Structured surface (°) | Coated surface (°) | Structured and coated surface (°) |
|---|---|---|---|---|
| Steel | — | — | 80 ± 5 | 105 ± 5 |
| PE (Stamylex) | — | — | 80 ± 5 | 130 ± 5 |

The large relative increase in the contact angles for both water and olive oil indicates that the modified surfaces of the different materials have become super-hydrophobic as well as super-oleophobic.

The surface modifications described may be applied to a traditional earwax guard or filter element, for example by embossing the material in the filter area with a pre-defined profile. Preferably, however, a perforated metal or polymer foil, which is structurally modified and coated according to the above, is incorporated in a supporting frame to obtain a barrier element according to the invention with improved hydrophobic and oleophobic characteristics. This can be done, for example, by casting the perforated foil in the supporting frame. Alternatively, laser welding, gluing, or other suitable processes may be applied to incorporate the perforated foil.

In order for the barrier element to meet the requirement of being acoustically transparent, it must be dimensioned so that the acoustic damping across the strainer in the relevant frequency range is maximum 3 dB. An example of such a barrier element is found in WO-A1-00/03561.

We claim:

1. A hearing aid comprising a receiver, an output port, a conduit for conveying sound to the port and a barrier element adapted for baffling entry of ear wax and moisture and for being acoustically transparent, wherein the barrier element comprises a slab with an exterior surface that has been microstructured and surface coated by molecular vapor deposition with a moisture repellant matter in such a way as to make the surface super-hydrophobic, and wherein the barrier element has a number of through-going pores, the diameter d of each of the pores being smaller than 200 microns.

2. The hearing aid according to claim 1, wherein the barrier element has a number of through-going pores, the diameter d of each of the pores being smaller than 100 microns.

3. The hearing aid according to claim 1, wherein the barrier element is dimensioned so that the acoustic damping across the element in the relevant frequency range is a maximum of 3 dB.

4. The hearing aid according to claim 1, wherein the barrier element is fitted inside an earpiece so as to be non-accessible to the user.

5. The hearing aid according to claim 1, comprising an earwax guard in the port, arranged acoustically downstream of the barrier element.

6. The hearing aid according to claim 1, comprising an acoustic filter arranged acoustically upstream of the barrier element.

7. A barrier element for a hearing aid comprising a slab having an exterior surface and through-going openings for transverse transmission of sound, wherein the exterior surface has been microstructured and surface coated by molecular vapor deposition with a moisture repellant matter in such a way as to make the surface super-hydrophobic, and wherein the through-going openings comprises pores each having a diameter d smaller than 200 microns.

8. The barrier element according to claim 7, wherein the through-going openings comprises pores each having a diameter d smaller than 100 microns.

9. The barrier element according to claim 7, wherein the exterior surface has an air content of at least 60%.

10. The barrier element according to claim 7, wherein the barrier element is dimensioned so that the acoustic damping across the element in the relevant frequency range is a maximum of 3 dB.

* * * * *